US008830136B2

(12) United States Patent
Mankaruse et al.

(10) Patent No.: US 8,830,136 B2
(45) Date of Patent: Sep. 9, 2014

(54) MOBILE WIRELESS COMMUNICATIONS DEVICE INCLUDING ACOUSTIC COUPLING BASED IMPEDANCE ADJUSTMENT AND RELATED METHODS

(75) Inventors: George Soliman Mankaruse, Kitchener (CA); George Shaker, Waterloo (CA); Sean Bartholomew Simmons, Waterloo (CA); Perry Jarmuszewski, Waterloo (CA)

(73) Assignee: BlackBerry Limited, Waterloo, Ontario (CA)

( * ) Notice: Subject to any disclaimer, the term of this patent is extended or adjusted under 35 U.S.C. 154(b) by 406 days.

(21) Appl. No.: 13/229,268

(22) Filed: Sep. 9, 2011

(65) Prior Publication Data

US 2013/0063323 A1 Mar. 14, 2013

(51) Int. Cl.
*H01Q 1/50* (2006.01)
*H01Q 1/24* (2006.01)

(52) U.S. Cl.
CPC ..... *H01Q 1/243* (2013.01)
USPC ..... 343/861; 343/860; 343/702

(58) Field of Classification Search
None
See application file for complete search history.

(56) References Cited

U.S. PATENT DOCUMENTS

| | | | | |
|---|---|---|---|---|
| 5,664,011 | A * | 9/1997 | Crochiere et al. | 379/406.08 |
| 6,590,538 | B1 | 7/2003 | Koyanagi et al. | |
| 6,608,603 | B2 * | 8/2003 | Alexopoulos et al. | 343/860 |
| 7,379,714 | B2 * | 5/2008 | Haque et al. | 455/107 |
| 7,859,474 | B1 * | 12/2010 | Cripe et al. | 343/745 |
| 8,196,470 | B2 * | 6/2012 | Gross et al. | 73/585 |
| 8,229,104 | B2 * | 7/2012 | Riedl et al. | 379/388.03 |
| 8,498,588 | B2 * | 7/2013 | Corrigan et al. | 455/90.3 |
| 8,512,241 | B2 * | 8/2013 | Bandy et al. | 600/302 |
| 8,532,312 | B2 * | 9/2013 | Ku et al. | 381/94.5 |
| 2003/0223382 | A1 * | 12/2003 | Popovic et al. | 370/286 |
| 2004/0017921 | A1 * | 1/2004 | Mantovani | 381/94.9 |
| 2006/0214784 | A1 * | 9/2006 | Koshimizu et al. | 340/539.1 |
| 2006/0240866 | A1 | 10/2006 | Eilts | |
| 2007/0082661 | A1 | 4/2007 | Black et al. | 455/418 |
| 2013/0260841 | A1 * | 10/2013 | Corrigan et al. | 455/571 |

FOREIGN PATENT DOCUMENTS

| | | |
|---|---|---|
| EP | 0518526 | 12/1992 |
| EP | 1748514 | 1/2007 |
| WO | 2004098070 | 11/2004 |

* cited by examiner

*Primary Examiner* — Trinh Dinh
(74) *Attorney, Agent, or Firm* — Allen, Dyer, Doppelt, Milbrath & Gilchrist, P.A.

(57) ABSTRACT

A mobile wireless communications device may include a portable housing, and an antenna carried by the portable housing. The mobile wireless communications device may further include wireless communications circuitry carried by the portable housing and an adjustable impedance matching network coupled between the wireless communications circuitry and the antenna. An audio input transducer and an audio output transducer may be carried by the portable housing. The mobile wireless communications device may further include a controller carried by the portable housing and configured to determine an acoustic coupling between the audio input transducer and the audio output transducer. The controller may further be configured to adjust the adjustable impedance matching network based upon the determined acoustic coupling.

25 Claims, 5 Drawing Sheets

MOBILE WIRELESS COMMUNICATIONS DEVICE INCLUDING ACOUSTIC COUPLING BASED IMPEDANCE ADJUSTMENT AND RELATED METHODS

TECHNICAL FIELD

The present disclosure generally relates to the field of wireless communications systems, and, more particularly, to mobile wireless communications devices and related methods.

BACKGROUND

Mobile wireless communications systems continue to grow in popularity and have become an integral part of both personal and business communications. For example, cellular telephones allow users to place and receive voice calls almost anywhere they travel. Moreover, as cellular telephone technology has increased, so too has the functionality of cellular devices and the different types of devices available to users. For example, many cellular devices now incorporate personal digital assistant (PDA) features such as calendars, address books, task lists, etc. Moreover, such multi-function devices may also allow users to wirelessly send and receive electronic mail (email) messages and access the Internet via a cellular network and/or a wireless local area network (WLAN), for example.

Even so, as the functionality of cellular communications devices continues to increase, so too does matching the demand for smaller devices which are easier and more convenient for users to carry. One challenge this poses for cellular device manufacturers is matching wireless communications circuitry with antennas to provide desired operating characteristics within the relatively limited amount of space available.

DETAILED DESCRIPTION OF THE PREFERRED EMBODIMENTS

Figure 1:
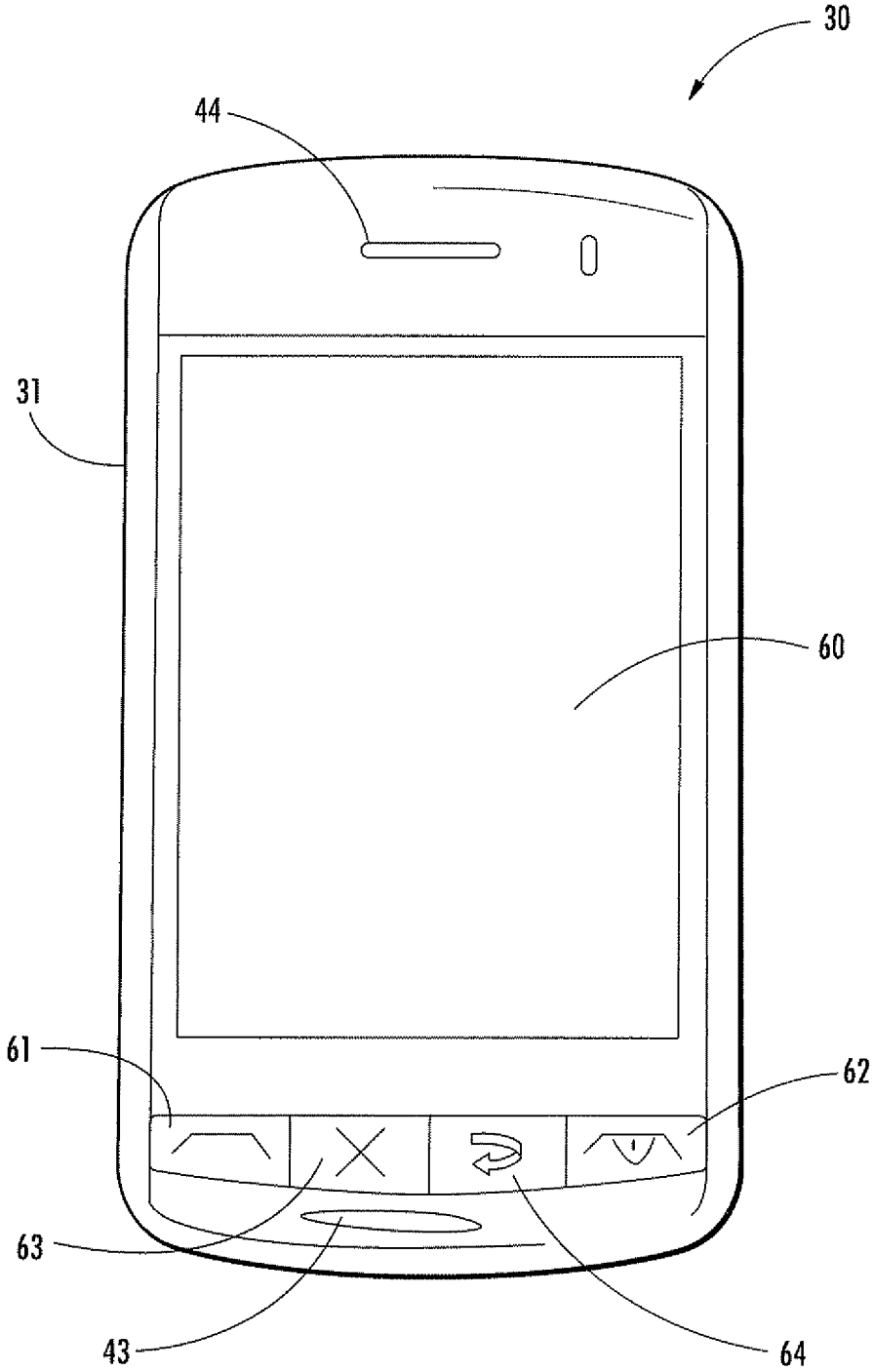
FIG. 1 is a top plan view of a mobile wireless communications device according to the present embodiments.
Figure 2:
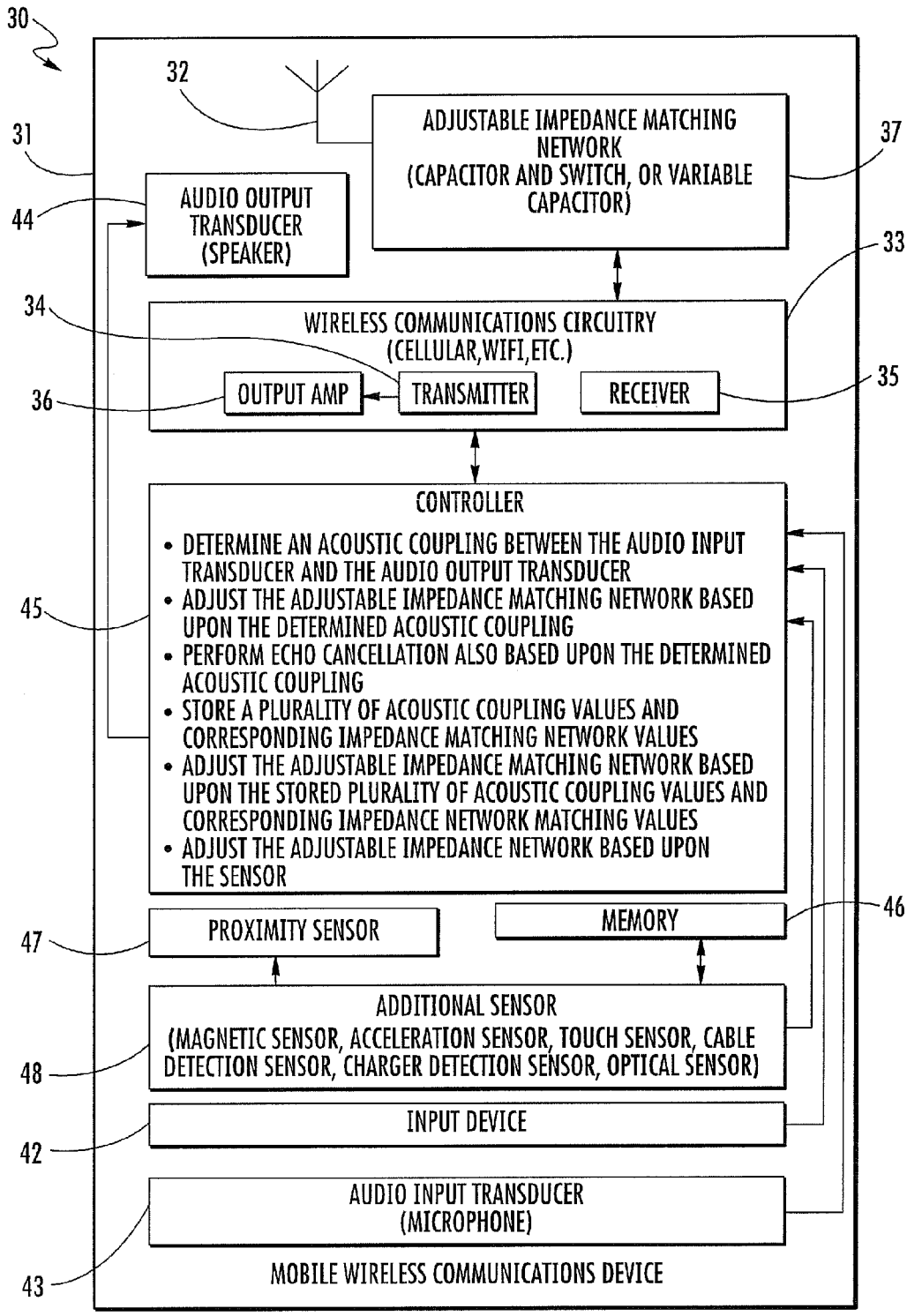
FIG. 2 is a schematic block diagram of a portion of the device of FIG. 1.

The present description is made with reference to the accompanying drawings, in which various embodiments are shown. However, many different embodiments may be used, and thus the description should not be construed as limited to the embodiments set forth herein. Rather, these embodiments are provided so that this disclosure will be thorough and complete. Like numbers refer to like elements throughout.

In accordance with an exemplary aspect, a mobile wireless communications device may include a portable housing, and an antenna carried by the portable housing. The mobile wireless communications device may further include wireless communications circuitry carried by the portable housing and an adjustable impedance matching network coupled between the wireless communications circuitry and the antenna, for example. An audio input transducer and an audio output transducer may be carried by the portable housing. The mobile wireless communications device may further include a controller carried by the portable housing and configured to determine an acoustic coupling between the audio input transducer and the audio output transducer, for example. The controller may further be configured to adjust the adjustable impedance matching network based upon the determined acoustic coupling.

The controller may also be configured to perform echo cancellation also based upon the determined acoustic coupling, for example. The mobile wireless communications device may further include a memory coupled to the controller and configured to store a plurality of acoustic coupling values and corresponding impedance matching network values, for example. The controller may be configured to adjust the adjustable impedance matching network based upon the stored plurality of acoustic coupling values and corresponding impedance network matching values, for example.

The mobile wireless communications device may further include a sensor carried by the portable housing and coupled to the controller. The controller may also be configured to adjust the adjustable impedance network based upon the sensor, for example.

The sensor may include a proximity sensor. The sensor may include a magnetic sensor. The sensor may also include one of an acceleration sensor, a touch sensor, a cable detection sensor, a charger detection sensor, and an optical sensor, for example. The mobile wireless communications device may further include an input device carried by the portable housing and coupled to the controller. The controller may also be configured to adjust the adjustable impedance network based upon the input device, for example.

The adjustable impedance matching network may include at least one capacitor and at least one switch coupled thereto, for example. The adjustable impedance matching network may include at least one variable capacitor.

A method aspect is directed to a method of controlling impedance matching between wireless communications circuitry and an antenna carried by a portable housing in a mobile wireless communications device. The method may include determining an acoustic coupling between an audio input transducer and an audio output transducer carried by a portable housing, for example. The method may further include adjusting an adjustable impedance matching network coupled between the antenna and the wireless communications circuitry based upon the determined acoustic coupling.

Referring initially to FIG. 1, an exemplary mobile wireless communications device 30 illustratively includes a portable housing 31. The portable housing 31 has opposing bottom and top portions.

An antenna 32 is also carried by the portable housing 31. The antenna 32 may be cellular antenna, for example. The antenna 32 may be another type of antenna, as will be appreciated by those skilled in the art.

The exemplary device 30 further illustratively includes a display 60 and a plurality of control keys including an "off hook" (i.e., initiate phone call) key 61, an "on hook" (i.e., discontinue phone call) key 62, a menu key 63, and a return or escape key 64. Operation of the various device components and input keys, etc., will be described further below with reference to FIG. 6.

The mobile wireless communications device 30 also includes wireless communications circuitry 33 carried by the portable housing. The wireless communications circuitry 33 may be configured to perform at least one wireless communications function. The wireless communications circuitry 33 may be configured to perform cellular communications, for example. The wireless communications circuitry 33 may be configured to operate at other frequencies or frequency bands, as will be appreciated by those skilled in the art.

The wireless communications circuitry 33 may include a wireless transmitter 34 and wireless receiver 35 configured to perform wireless transmit and receive functions, respectively. The wireless communications circuitry 33 may also include an output amplifier 36 coupled to the wireless transmitter 34, for example. The wireless communications circuitry 33 may include additional or other components or circuitry for performing wireless communications functions.

The mobile wireless communications device 30 also includes an adjustable impedance matching network 37 coupled between the wireless communications circuitry 33 and the antenna 32. The adjustable impedance matching network 37 includes a plurality of capacitors and switches coupled thereto for adjusting the capacitance of the adjustable impedance matching network. The adjustable impedance matching network 37 may include a microelectromechanical systems capacitor, for example. The adjustable impedance matching network 37 may include other types of capacitors and/or switches so that adjustments can be made, as will be appreciated by those skilled in the art.

An audio input transducer 43 is illustratively carried by the portable housing 31. The audio input transducer is illustratively configured to operate as a microphone at the lower end of the housing 31. The audio input transducer 43 may be carried elsewhere by the portable housing 31, and more than one audio input transducer may be carried by the portable housing.

An audio output transducer 44 is illustratively may be carried by the portable housing 31. The audio output transducer 44 is illustratively configured to operate as a speaker, for example. The audio output transducer 44 is illustratively carried by the top of the portable housing 31. The audio output transducer 44 may be carried elsewhere by the portable housing 31, and more than one audio output transducer may be carried by the portable housing such as a speakerphone on the rear of the housing 31.

A controller 45, or processor, is also carried by the portable housing 31. The controller 45 is configured to determine an acoustic coupling between the audio input transducer 43 and the audio output transducer 44.

The controller 45 is also configured to adjust the adjustable impedance matching network 37 based upon the determined acoustic coupling. The mobile wireless communications device 30 also includes a memory 46 coupled to the controller 45 and configured to store a plurality of the determined acoustic coupling values and corresponding impedance matching network values. For example, eight different sets of corresponding determined acoustic coupling values and impedance matching network values may be stored in the memory 46. Of course, more sets of corresponding determined acoustic coupling values and impedance matching network values may be stored in the memory 46. The impedance matching network values may be empirically determined.

As will be appreciated by those skilled in the art, an acoustic coupling value, stored in the memory 46, for example, in dB, may correspond to a position or angle of the mobile wireless communications device 30 with respect to a user, for example. In other words, the acoustic coupling value is affected by an object's proximity to the mobile wireless communications device 30. For example, an acoustic coupling value may be determined when the user is talking on the mobile wireless communications device 30, while another determined acoustic coupling value may be determined when the user is typing, or when the mobile wireless communications device is not being held by the user. The acoustic coupling value is typically larger when the mobile wireless communications device 30 is placed on a wood table, for example, as compared to an acoustic coupling value in free-space.

The controller 45 adjusts the adjustable impedance matching network 37 based upon the stored plurality of acoustic coupling values and corresponding impedance network matching values. More particularly, the controller 45 may adjust the switches to, in essence, turn on or turn off capacitors. Alternatively, the adjustable impedance matching network 37 may include a variable capacitor 41 instead of capacitors and switches. This may advantageously reduce the quantity of discrete components, and thus further reduce the amount of space used within the portable housing 31.

In some embodiments, the controller 45 may not use the stored plurality of acoustic coupling values, but may calculate the corresponding impedance matching network value based upon an algorithm, for example, that may be stored in the memory 46. Additionally, the controller 45 may determine the acoustic coupling value and adjust the impedance matching network in near real time, for example. This advantageously allows for the impedance of the wireless communications circuitry 33 and the antenna 32 to be matched, for example, to within ±10% of each other, to allow an increased efficiency of power transfer therebetween for the different orientations of the mobile wireless communications device 30. The impedance of the wireless communications circuitry 33 and the antenna 32 may be matched to other tolerances as will be appreciated by those skilled in the art.

The controller 45 may also be advantageously configured to perform echo cancellation also based upon the determined acoustic coupling, for example. In other words, the determined acoustic coupling value is also used for echo cancellation. As will be appreciated by those skilled in the art, echo cancellation between the audio input device 43 and the audio output device 44 is highly desired so that a user does not hear his own voice through the audio output device when speaking into the audio input device. Echo cancellation is also used to cancel echo for another user on the line (i.e. remote or landline user). If echo cancellation is not configured properly, the other user may hear himself back through his handset or landline phone. The user of the mobile wireless communications device 30 may not be able to tell if the echo cancellation is working or not.

The mobile wireless communications device 30 also includes a proximity sensor 47 carried by the portable housing 31 and coupled to the controller 45. The proximity sensor 47. More particularly, the proximity sensor 47 is configured to detect proximity to a user, for example, when the mobile wireless communications device 30 is held adjacent a user's face. The proximity sensor 47 cooperates with the controller 45 to adjust the adjustable impedance matching network 37 also based upon the proximity. For example, if the mobile wireless communications device 30 is adjacent the user's face and is held in a particular orientation, which corresponds to a determined acoustic coupling value, the controller 45 may adjust the adjustable impedance matching network 37 accordingly. In other words, the status of the proximity sensor 47, i.e. on or off, may be another data entry in the table stored in the memory 46, or used in the algorithm, for determining the corresponding impedance matching network value. This advantageously may result in an increased accuracy impedance matching network value.

An additional sensor 48 may carried by the portable housing 31 and coupled to the controller 45. The additional sensor 48 may be in the form of a magnetic sensor for determining when the mobile wireless communications device 30 is in holster, for example.

The additional sensor 48 may also be in the form of an acceleration sensor or accelerometer, to determine when the mobile wireless device 30 is in motion. The additional sensor 48 may also be in the form of a touch sensor for determining when the mobile wireless communications device 30 is being held by a user or being operated by a user, for example, via a touch screen input. The additional sensor 48 may also be in the form of a cable detection sensor for determining when the mobile wireless communications device 30 is tethering to another device, for example, a personal computer.

The additional sensor 48 may also be in the form of a charger detection sensor for determining when the mobile wireless communications device 30 is being charged and/or is coupled to a charger.

The additional sensor 48 may also be in the form of an optical sensor. Of course, more than one additional sensor 48 may be used and each may be in different form, and may cooperate with the controller 45, similar to the proximity sensor 47, to adjust the adjustable impedance matching network 37 also based thereon. The additional sensor 48 cooperating with the controller 45 may provide increased accuracy impedance matching network value, which thus may result in improved antenna performance by reducing losses.

The mobile wireless communications device 30 may also include an input device 42 which may be in the form of push buttons, for example, the control keys 61-64. The input device 42 may be in the form of a keypad, keyboard, trackball, or other input device, for example. The input device 42 is coupled to the controller 45. The controller 45 adjusts the adjustable impedance matching network, and, more particularly, the impedance matching network value, based upon the input device 42. The input device 42 may determine when the mobile wireless communications device 30 is being used, for example.

For example, one possible scenario would be when the user is on a phone call, placing the mobile wireless communications device 30 in proximity to the user's face. The proximity detector 47 is typically triggered to disable a touch panel, i.e an additional sensor 48 in the form of a touch sensor, to put the display 60 in a standby mode. The information from the proximity detector 47 may be classified as a "one" in a binary form, meaning that there is insufficient information to detect the relative position of the wireless device with the respect to the user's face based upon this information alone. In contrast, it is typically possible to find a measurable difference in the echo information, i.e. echo coupling. Analyzing performance of the antenna 32 along with echo coupling in such positions advantageously allows for a lookup table in the memory 46 for an increased number of possible variations. It is thus possible to predict the deviation of impedance of the antenna 32 from a desired or matched value due to proximity of the user's face by relying on the proximity sensor 47 along with the echo coupling information.

In prior art mobile wireless communications devices, there is an increasing demand for integrating more wireless communications circuitry, for example, to communicate over multiple frequency bands, into a relatively small size portable housing. The most sensitive component to user interactions with respect to wireless communications circuitry is typically the corresponding antenna(s). As will be appreciated by those skilled in the art, the antenna 32 may be designed to operate with corresponding wireless communications circuitry 33 for certain loading conditions. In a more realistic scenario, user interaction would impose different loading conditions on the wireless communications circuitry 33, thus deteriorating the operational mode from what may be considered optimal conditions.

One approach to address this is to use RF tuners to maintain the loading conditions as close as possible for all possible realistic scenarios. However, such RF tuners generally result in increased power consumption, higher RF losses and higher space/cost constraints. Moreover, RF tuners typically require a complex impedance detection algorithm or circuitry. This is usually reflected in a deterioration of the overall system performance, i.e., a decrease in radiation efficiency and total radiated power. Thus, adding additional circuitry for the detection of impedance variation of the antenna with different usage scenarios generally negatively impacts the overall power consumption and efficiency of a mobile wireless communications device.

The mobile wireless communications device 30 of the present embodiments advantageously uses the determined acoustic coupling and sensor information for impedance adjustment and may be used for other or additional processing. In other words, the addition of circuitry for impedance adjustment in the mobile wireless communications device 30 is greatly reduced.

Figure 3:
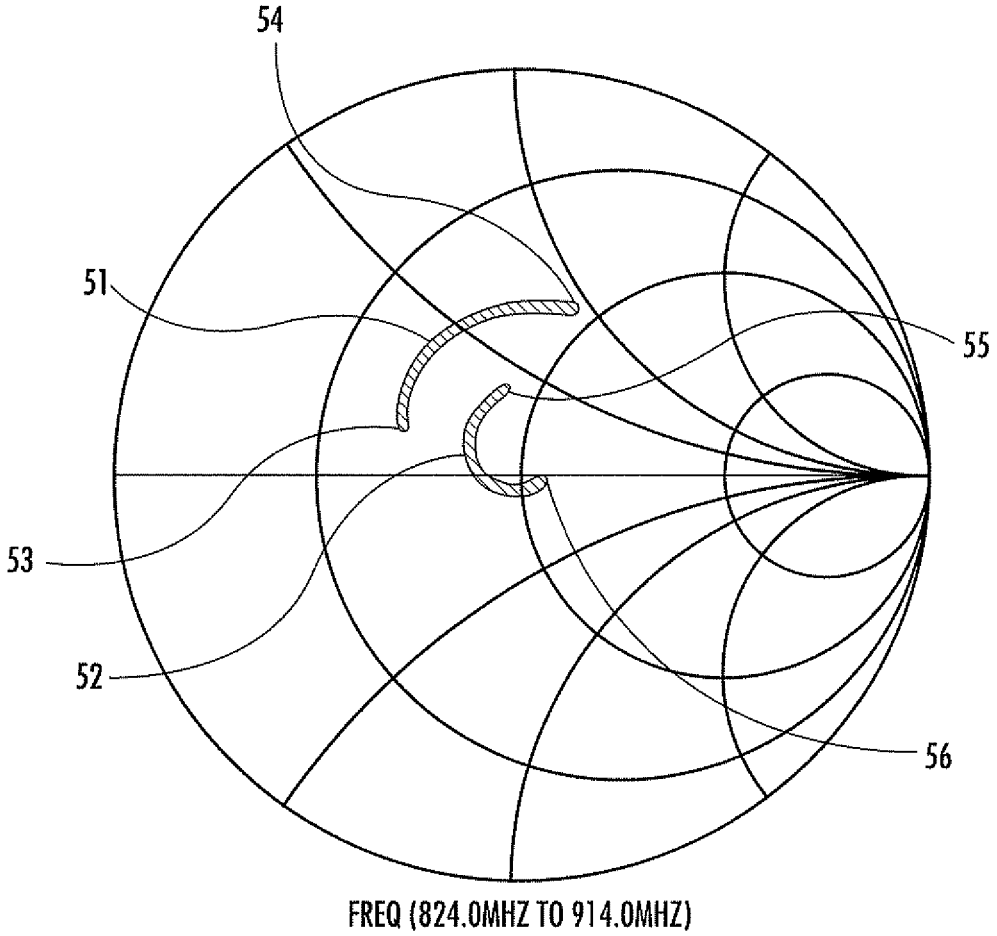
FIG. 3 is a Smith chart of measured antenna parameters for a prototype mobile wireless communications device in accordance with an exemplary embodiment.

Referring now to the Smith chart in FIG. 3, frequency, reflection coefficients, and impedance measured for a prototype mobile wireless communications device similar to that the mobile wireless communications device 30 described above are illustrated. The Smith chart illustrates the relationship among the above parameter with respect to the position or orientation of the mobile wireless communications device. Line 51 corresponds to the mobile wireless communications device being adjacent a user's face. The echo coupling is 60 dB. Line 52 corresponds to the mobile wireless communications device being spatially separated from the user's face and has an echo coupling of 52 dB. Point 53 has a frequency of 824 MHz, S parameter of S(2,2)=0.31/154.684, and impedance of Z0*(0.545+j0.16). Point 54 has a frequency of 914 MHz, S parameter of S(2,2)=0.438/71.601, and impedance of Z0*(0.883+j0.908). Point 55 has a frequency of 914 MHz, S parameter of S(9,9)=0.222/95.739, and impedance of Z0*(0.87+j0.403). Point 56 has a frequency of 824 MHz, S parameter of S(9,9)=0.067/−11.478, and impedance of Z0*(1.140−j0.031).

Figure 4:
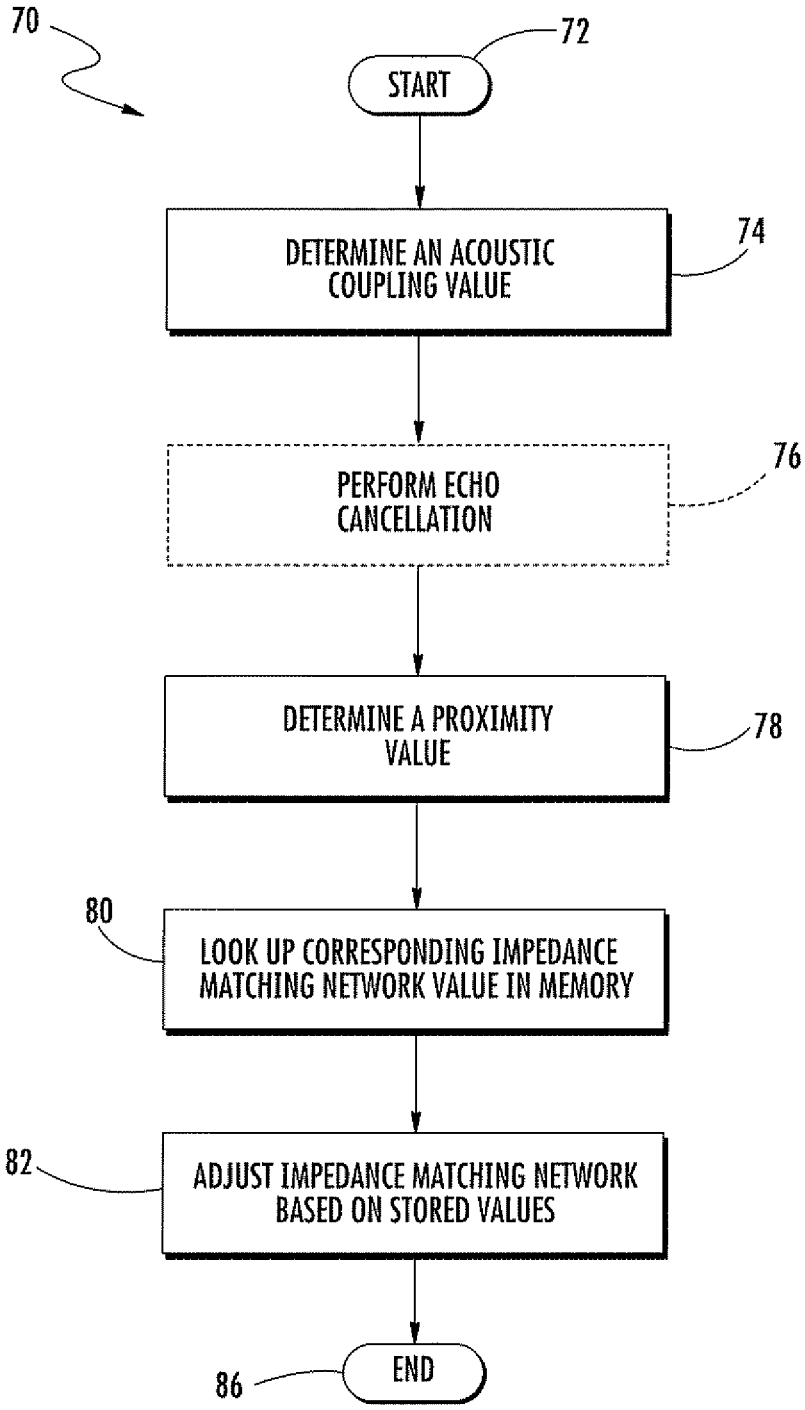
FIG. 4 is flow chart of a method of controlling impedance matching in accordance with an exemplary embodiment.

Referring now to the flowchart 70 in FIG. 4, a method of controlling impedance matching between wireless communications circuitry 33 and an antenna 32 carried by a portable housing 31 in a mobile wireless communications device 30 is illustrated. Beginning at Block 72, the method includes determining an acoustic coupling between an audio input transducer 43 and an audio output transducer 44 carried by the portable housing 31 (Block 74). At Block 76, the method includes optionally performing echo cancellation also based upon the determined acoustic coupling. A proximity value corresponding to a proximity of a user is determined via a proximity sensor 47 at Block 78.

A corresponding impedance matching network value of an adjustable impedance matching network 37 coupled between the antenna 32 and the wireless communications circuitry 33 is retrieved from the memory 46 (Block 80). The impedance matching network 37 is adjusted based stored value (Block 82). By adjusting the adjustable impedance matching network value, the impedance between the wireless communications circuitry 33 and the antenna 32 is advantageously matched, for example, to within a threshold, as will be appreciated by those skilled in the art. The method ends at Block 86.

Example components of a mobile wireless communications device 1000 that may be used in accordance with the above-described embodiments are further described below with reference to FIG. 5. The device 1000 illustratively includes a housing 1200, a keyboard or keypad 1400 and an output device 1600. The output device shown is a display 1600, which may comprise a full graphic LCD. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400.

The housing 1200 may be elongated vertically, or may take on other sizes and shapes (including clamshell housing structures). The keypad may include a mode selection key, or other hardware or software for switching between text entry and telephony entry.

Figure 5:
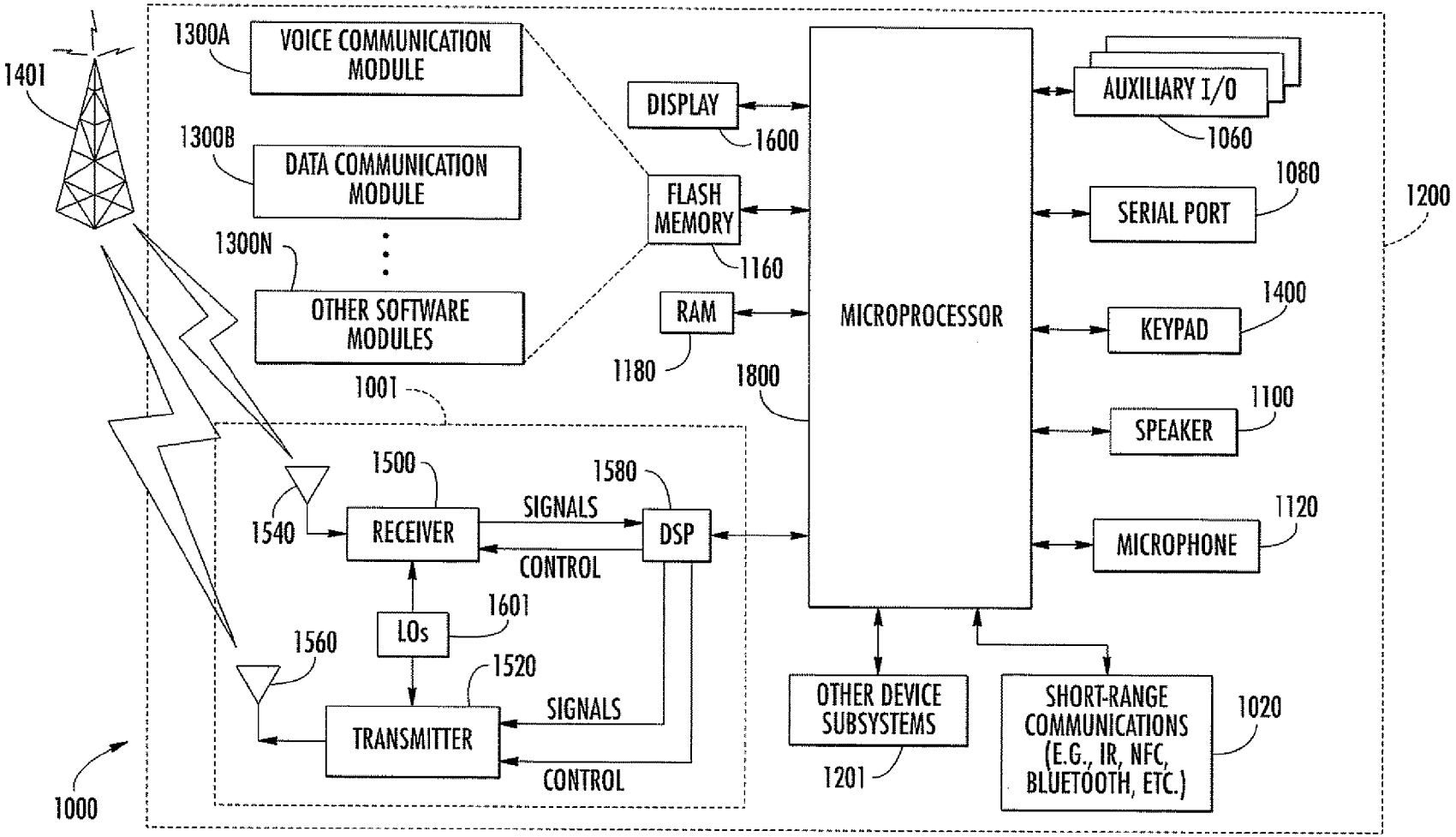
FIG. 5 is a schematic block diagram illustrating additional components that may be included in the mobile wireless communications device of FIG. 1

In addition to the processing device 1800, other parts of the mobile device 1000 are shown schematically in FIG. 5. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 may comprise a two-way RF communications device having data and, optionally, voice communications capabilities. In addition, the mobile device 1000 may have the capability to communicate with other computer systems via the Internet.

Operating system software executed by the processing device 1800 is stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM may be capable of organizing and managing data items, such as e-mail, calendar events, voice mails, appointments, and task items. The PIM application may also be capable of sending and receiving data items via a wireless network 1401. The PIM data items may be seamlessly integrated, synchronized and updated via the wireless network 1401 with corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TACT™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000. The mobile device 1000 may also be compliant with other communications standards such as 3GSM, 3GPP, UMTS, 4G, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore typically involves use of a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device may also be used to compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, a Bluetooth™ communications module to provide for communication with similarly-enabled systems and devices, or a near field communications (NFC) sensor for communicating with a NFC device or NFC tag via NFC communications.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A mobile wireless communications device comprising:
a portable housing;
an antenna carried by said portable housing;
wireless communications circuitry carried by said portable housing;
an adjustable impedance matching network coupled between said wireless communications circuitry and said antenna;
an audio input transducer and an audio output transducer carried by said portable housing; and
a controller carried by said portable housing and configured to
determine an acoustic coupling between said audio input transducer and said audio output transducer, and
adjust said adjustable impedance matching network based upon the determined acoustic coupling.

2. The mobile wireless communications device according to claim 1, wherein said controller is configured to perform echo cancellation also based upon the determined acoustic coupling.

3. The mobile wireless communications device according to claim 1, further comprising a memory coupled to said controller and configured to store a plurality of acoustic coupling values and corresponding impedance matching network values; and wherein said controller is configured to adjust said adjustable impedance matching network based upon the stored plurality of acoustic coupling values and corresponding impedance network matching values.

4. The mobile wireless communications device according to claim 1, further comprising a sensor carried by said portable housing and coupled to said controller; and wherein said controller is also configured to adjust said adjustable impedance network based upon said sensor.

5. The mobile wireless communications device according to claim 4, wherein said sensor comprises a proximity sensor.

6. The mobile wireless communications device according to claim 4, wherein said sensor comprises a magnetic sensor.

7. The mobile wireless communications device according to claim 4, wherein said sensor comprises one of an acceleration sensor, a touch sensor, a cable detection sensor, a charger detection sensor, and an optical sensor.

8. The mobile wireless communications device according to claim 1, further comprising an input device carried by said housing and coupled to said controller; and wherein said controller is also configured to adjust said adjustable impedance network based upon said input device.

9. The mobile wireless communications device according to claim 1, wherein said adjustable impedance matching network comprises at least one capacitor and at least one switch coupled thereto.

10. The mobile wireless communications device according to claim 1, wherein said adjustable impedance matching network comprises at least one variable capacitor.

11. A mobile wireless communications device comprising:
a portable housing;
an antenna carried by said portable housing;
wireless communications circuitry carried by said portable housing;
an adjustable impedance matching network coupled between said wireless communications circuitry and said antenna;
an audio input transducer and an audio output transducer carried by said portable housing;
a sensor carried by said portable housing and coupled to said controller; and
a controller carried by said portable housing and configured to
determine an acoustic coupling between said audio input transducer and said audio output transducer,
adjust said adjustable impedance matching network based upon the determined acoustic coupling, and said sensor, and
perform echo cancellation also based upon the determined acoustic coupling.

12. The mobile wireless communications device according to claim 11, further comprising a memory coupled to said controller and configured to store a plurality of acoustic coupling values and corresponding impedance matching network values; and wherein said controller is configured to adjust said adjustable impedance matching network based upon the stored plurality of acoustic coupling values and corresponding impedance network matching values.

13. The mobile wireless communications device according to claim 11, wherein said sensor comprises a proximity sensor.

14. The mobile wireless communications device according to claim 11, wherein said sensor comprises a magnetic sensor.

15. The mobile wireless communications device according to claim 11, wherein said sensor comprises one of an acceleration sensor, a touch sensor, a cable detection sensor, a charger detection sensor, and an optical sensor.

16. The mobile wireless communications device according to claim 11, further comprising an input device carried by said housing and coupled to said controller; and wherein said controller is also configured to adjust said adjustable impedance network based upon said input device.

17. The mobile wireless communications device according to claim 11, wherein said adjustable impedance matching network comprises at least one capacitor and at least one switch coupled thereto.

18. The mobile wireless communications device according to claim 11, wherein said adjustable impedance matching network comprises at least one variable capacitor.

19. A method of controlling impedance matching between wireless communications circuitry and an antenna carried by a portable housing in a mobile wireless communications device, the method comprising:
determining an acoustic coupling between an audio input transducer and an audio output transducer carried by a portable housing; and
adjusting an adjustable impedance matching network coupled between the antenna and the wireless communications circuitry based upon the determined acoustic coupling.

20. The method according to claim 19, further comprising performing echo cancellation also based upon the determined acoustic coupling.

21. The method according to claim 19, further comprising:

storing a plurality of acoustic coupling values and corresponding impedance matching network values in a memory; and adjusting the adjustable impedance matching network based upon the stored plurality of acoustic coupling values and corresponding impedance network matching values.

22. The method according to claim 19, further comprising adjusting the adjustable impedance network based upon a sensor carried by the portable housing.

23. The method according to claim 22, wherein the sensor comprises a proximity sensor.

24. The method according to claim 19, wherein the adjustable impedance matching network comprises at least one capacitor and at least one switch coupled thereto.

25. The method according to claim 19, wherein the adjustable impedance matching network comprises at least one variable capacitor.

* * * * *